US005941386A

United States Patent [19]

Hu et al.

[11] Patent Number: 5,941,386

[45] Date of Patent: Aug. 24, 1999

[54] PORTABLE TOOL HOLDER WITH THEFT PREVENTION

[75] Inventors: Bobby Hu, Taipei; Jessie Chow, Taichung, both of Taiwan

[73] Assignee: Hand Tool Design Corporation, Wilmington, Del.

[21] Appl. No.: 09/084,343

[22] Filed: May 26, 1998

[51] Int. Cl.[6] ..... B65D 85/28

[52] U.S. Cl. ..... 206/376; 206/485; 206/807; 211/70.6; 294/161

[58] Field of Search ..... 206/372, 373–376, 206/377, 379, 483, 485, 807; 211/69, 70.6; 294/161, 165, 166

[56] References Cited

U.S. PATENT DOCUMENTS

| | | | |
|---|---|---|---|
| 2,119,217 | 5/1938 | Rocchi | 206/376 |
| 4,911,297 | 3/1990 | Suburu | 206/376 |
| 5,036,975 | 8/1991 | Chow | 206/373 |
| 5,346,063 | 9/1994 | Chow | 206/376 |
| 5,505,316 | 4/1996 | Lee | 206/376 |
| 5,598,924 | 2/1997 | McCann | 206/372 |
| 5,730,303 | 3/1998 | Chow | 206/376 |
| 5,788,303 | 8/1998 | Chia-Hsiang | 206/376 |

*Primary Examiner*—Paul T. Sewell
*Assistant Examiner*—Luan K. Bui
*Attorney, Agent, or Firm*—Charles E. Baxley

[57] ABSTRACT

A tool holder includes an upper end wall, a lower end wall, two lateral walls each having an upper portion, and a bottom wall. The lower end wall includes a number of spaced first notches defined therein and spaced along a lengthwise direction thereof. A wall defining a portion of each notch includes a retaining end edge formed on a distal end thereof for securely retaining an end of a tool. A restraining member is removably mounted to the lower end wall to prevent the tool held by the tool holder from being removed. The restraining member includes a number of second notches respectively aligning with the first notches and through which the other end of the tool extends.

5 Claims, 4 Drawing Sheets

PORTABLE TOOL HOLDER WITH THEFT PREVENTION

BACKGROUND OF THE INVENTION

1. Field of the Invention

The present invention relates to a portable holder which may reliably retain the tools in position and have a theft-prevention design to prevent the tools from being stolen.

2. Description of the Related Art

A typical toolbox generally includes a number of recesses defined in an interior surface thereof for receiving, e.g., sockets, wrenches, etc., which often causes inconvenience to the user when removing the tools out from the recesses, and sometimes may even cause pain to the user's fingers. In addition, the tools may fall off from the toolbox if inadvertently opened and thus get into a mess. Furthermore, the tools are often packaged in non-transparent material such that the customers cannot see the tools clearly. U.S. Pat. No. 5,346,063 to Chow, filed on Apr. 27, 1993 and issued on Sep. 13, 1994, discloses a tool holder comprising a pair of walls extended forward from a board, a number of pairs of notches defined in the walls for accommodating the tools, and a number of resilient members projected forwardly of the board and each aligned with one pair of the notches for biasing the tools against the shoulders formed on the notches so as to stably hold the tools in place. Nevertheless, two ends of each of the tools held on the tool holder extend laterally outward beyond the tool holder and thus occupy a space, and the ends of the tools outside the tool holder may be inadvertently impinged and thus cause damage to the shoulder of the tool holder.

Applicant's U.S. patent application Ser. No. 08/963,469 filed on Nov. 3, 1997 discloses a portable tool holder which may reliably retain the tools in position. Yet, the tools on the tool holder may be easily removed during display and thus cannot be against theft. The whole set of tools is no longer salable even if a single tool is lost. The present invention is intended to provide an improved design to solve this problem.

SUMMARY OF THE INVENTION

It is a primary object of the present invention to provide a portable tool holder which may reliably retain the tools thereon and prevent the tools from being stolen.

A tool holder in accordance with the present invention comprises an upper end wall, a lower end wall, two lateral walls each having an upper portion, and a bottom wall. The lower end wall includes a plurality of spaced first notches defined therein and spaced along a lengthwise direction thereof. A wall defining a portion of each notch includes a retaining end edge formed on a distal end thereof adapted to securely retain an end of a tool. A beam extends across the upper portions of the two lateral walls and includes a plurality of separation ribs formed on an underside thereof to thereby define a plurality of guiding/retaining channels between each two adjacent separation ribs. The bottom wall includes a plurality of resilient members provided thereon, wherein each resilient member aligns with an associated guiding/retaining channel and an associated first notch. One of two ends of a tool held by the tool holder is extended through an associated guiding/retaining channel, and the other end of the tool is received in an associated first notch and retained by an associated retaining end edge, while a mediate portion of the tool is biased by an associated resilient member such that the two ends of the tool respectively bear against the beam and the retaining end edge so as to hold the tool in place. In addition, a restraining member is removably mounted to the lower end wall to prevent the tool held by the tool holder from being removed. The restraining member includes a plurality of second notches respectively aligning with the first notches and through which the other end of the tool extends.

Each resilient member is arcuate and includes a depression defined in a mediate section thereof. Each first notch is oblong and extends in a direction at an acute angle with a lengthwise direction of the endwall. Each second notch is oblong and extends in a direction at an acute angle with a lengthwise direction of the restraining member. The restraining member includes at least one snapping fastener with a snapping head, and the bottom wall of the main body includes at least one hole defined therein through which the snapping head is passable.

Other objects, advantages, and novel features of the invention will become more apparent from the following detailed description when taken in conjunction with the accompanying drawings.

DESCRIPTION OF THE PREFERRED EMBODIMENT

Figure 1:
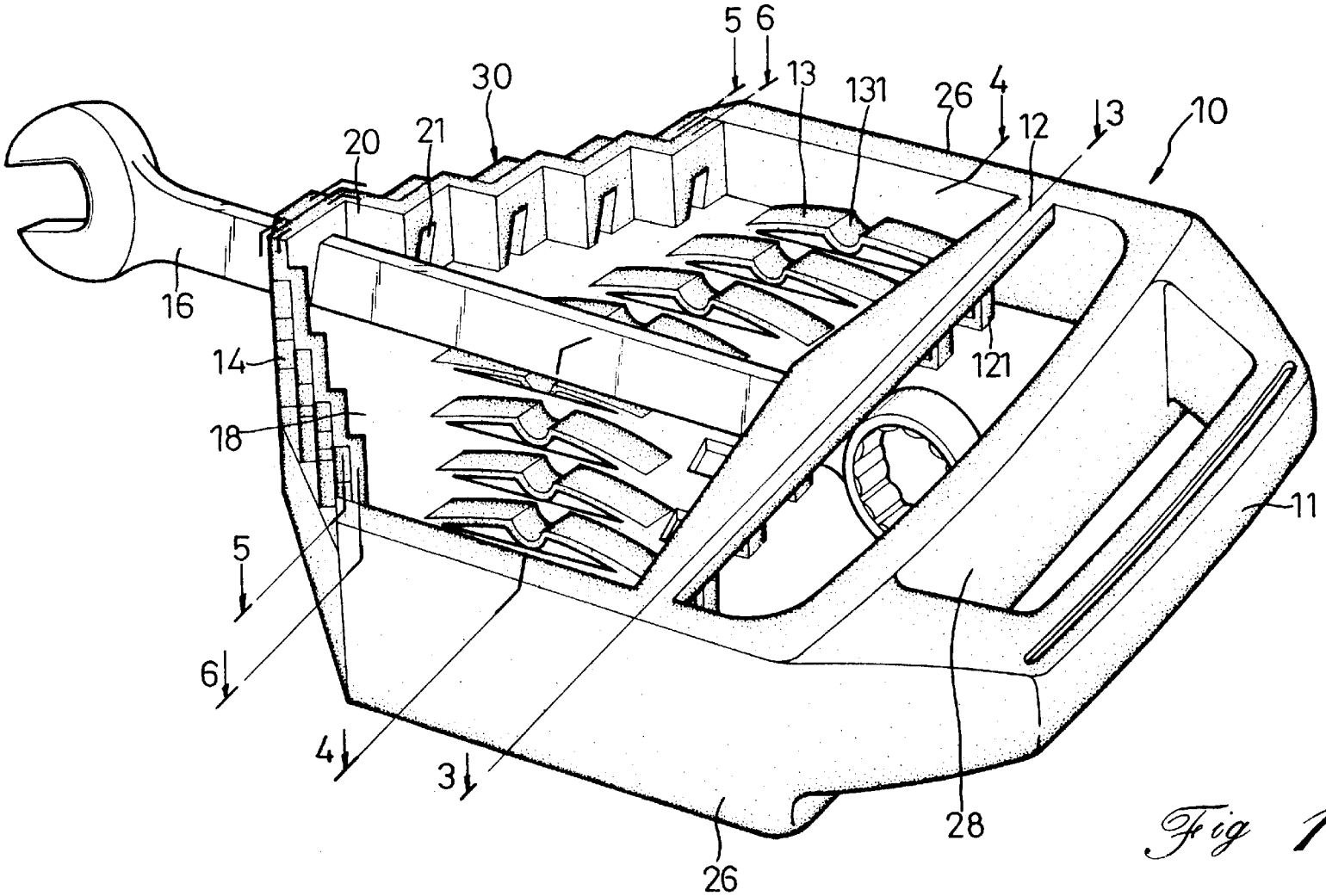
FIG. 1 is a perspective view of a portable tool holder in accordance with the present invention.
Figure 2:
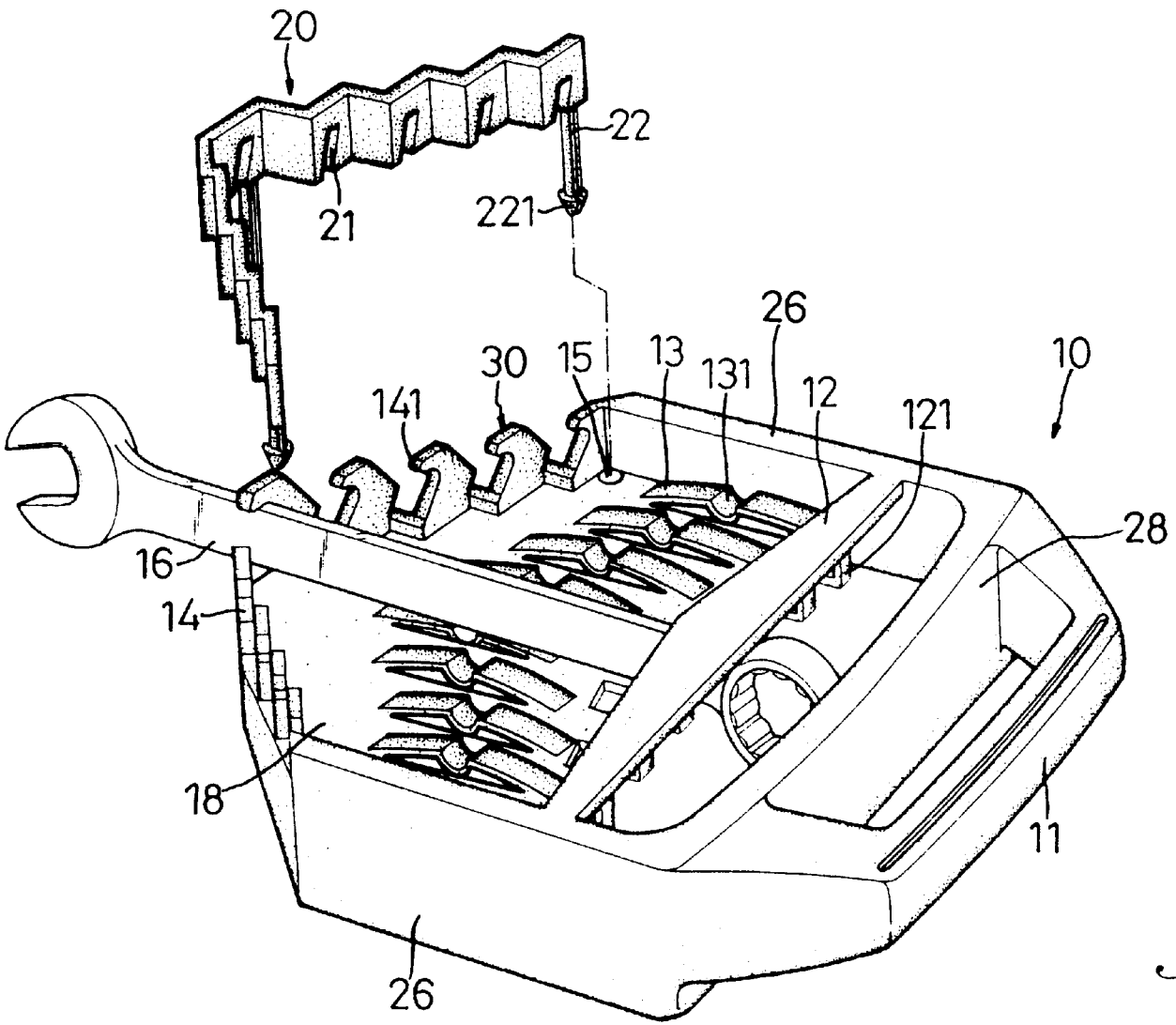
FIG. 2 is a perspective view, partially exploded, of the portable tool holder in accordance with the present invention.
Figure 3:
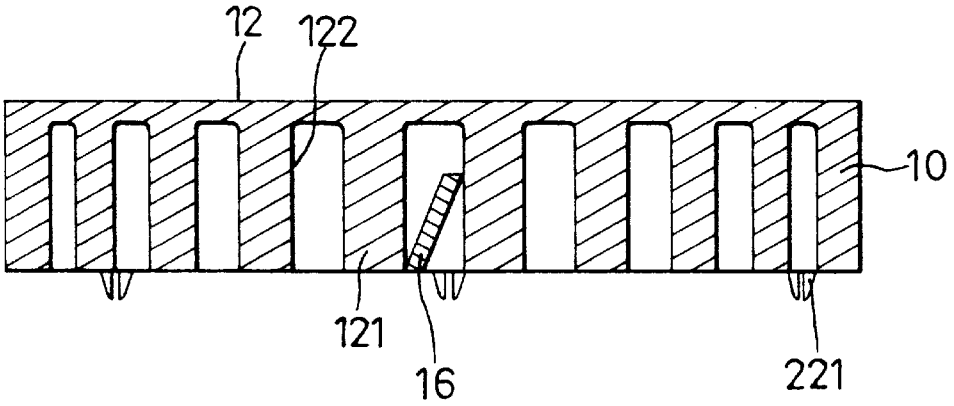
FIG. 3 is a sectional view taken along line 3—3 in FIG. 1.

Referring to the drawings and initially to FIGS. 1 and 2, a portable tool holder in accordance with the present invention generally comprises a main body 10 which includes a bottom wall 18, two lateral walls 26, an upper end wall 28, and a lower end wall 30. The upper end wall 28 has a handle 11 provided thereon for ease of carriage as well as display on a wall by a hook or the like. A beam 12 extends across upper portions of the two lateral walls 26 and includes a number of separation ribs 121 formed on an underside thereof to thereby define a number of guiding/retaining channels 122 (FIG. 3) between each two adjacent separation ribs 121.

The lower end wall 30 is preferably zigzag and includes a number of lengthwise spaced notches 14. Each notch 14 is preferably oblong and extends in a direction at an acute angle with the lengthwise direction of the lower end wall 30. In addition, a wall defining a portion of each notch 14 includes a retaining end edge 141 formed on a distal end thereof for securely retaining an end of a tool 16.

Figure 4:
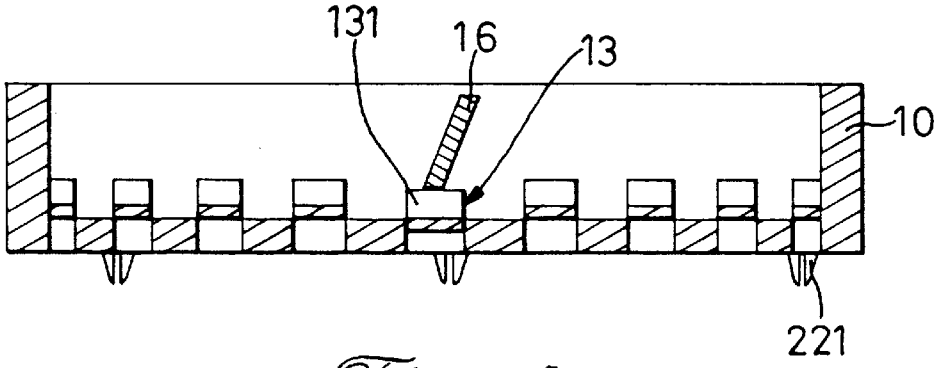
FIG. 4 is a sectional view taken along line 4—4 in FIG. 1.
Figure 5:
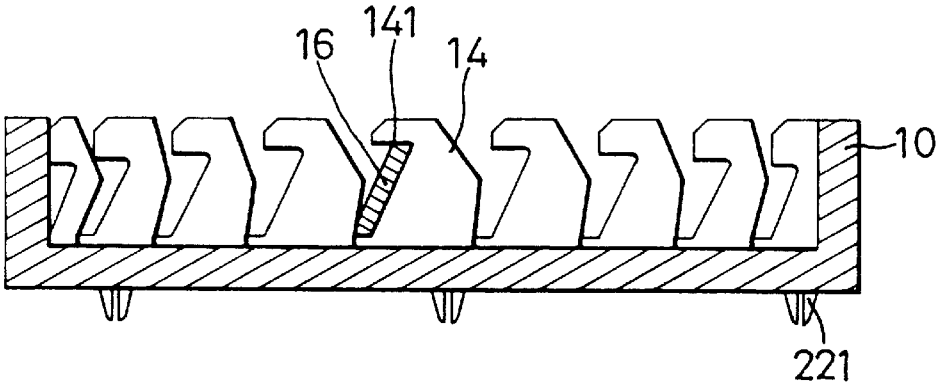
FIG. 5 is a sectional view taken along line 5—5 in FIG. 1.
Figure 6:
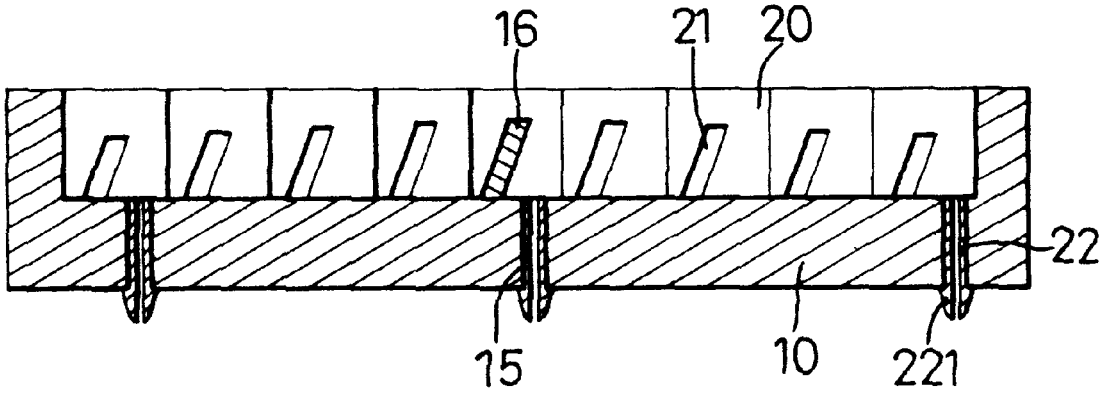
FIG. 6 is a sectional view of a spanner and a restraining member of the tool holder.

The bottom wall 18 includes a plurality of resilient members 13. Each resilient member 13 aligns with an associated guiding/retaining channel 122 and an associated notch 14 for biasing a mediate portion of the tool 16 upwardly (FIGS. 1 and 4), wherein two ends of the tool 16 are respectively retained in the associated guiding/retaining channel 122 and the associated notch 14 (FIGS. 5 and 6). In addition, each resilient member 13 is preferably arcuate and includes a depression 131 defined in a mediate section thereof which may absorb a portion of deformation and thus prevent the resilient member 13 from being broken when the resilient member 13 is pressed downwardly, e.g., when inserting a tool into a space defined between aligned notch 141 and guiding/receiving channel 122, and an example of which is shown in U.S. Pat. No. 5,346,043 and U.S. patent application Ser. No. 08/963,469, which is incorporated herein for reference.

The tool holder in accordance with the present invention further includes a restraining member 20 which is shaped corresponding to the outline of the lower end wall 30. In this embodiment, the restraining member 20 is zigzag and includes three snapping fasteners 22 (each with a snapping head 221) projecting outwardly therefrom. The retaining member 20 further includes a number of notches 21 which are respectively aligned with the notches 14 of the lower end wall 30 when the restraining member 20 is attached to the lower end wall 30 by means of extending the snapping heads 221 through holes 15 defined in the bottom wall 18. As a result, the tool 16 cannot be removed before the restraining member 20 is disengaged from the lower end wall 30.

According to the above description, it is appreciated that the tool holder of the present invention can protect the tools held thereon from being stolen during display in addition to securely retaining the tools in position.

Although the invention has been explained in relation to its preferred embodiment, it is to be understood that many other possible modifications and variations can be made without departing from the spirit and scope of the invention as hereinafter claimed.

What is claimed is:

1. A tool holder comprising an upper end wall, a lower end wall, two lateral walls each having an upper portion, and a bottom wall, the lower end wall including a plurality of spaced first notches defined therein and spaced along a lengthwise direction thereof, a wall which defines a portion of each said notch including a retaining end edge formed on a distal end thereof adapted to securely retain an end of a tool, a beam extending across said upper portions of said two lateral walls and including a plurality of separation ribs formed on an underside thereof to thereby define a plurality of guiding/retaining channels between each two adjacent said separation ribs, the bottom wall including a plurality of resilient members provided thereon, each said resilient member aligning with an associated said guiding/retaining channel and an associated said first notch, one of two ends of a tool adapted to be held by the tool holder being extended through an associated said guiding/retaining channel, the other end of the tool being received in an associated said first notch and retained by an associated said retaining end edge, a mediate portion of the tool being biased by an associated said resilient member such that the two ends of the tool respectively bear against said beam and said retaining end edge so as to hold the tool in place, and further comprising a restraining member removably mounted to the lower end wall to prevent the tool held by the tool holder from being removed, the restraining member including a plurality of second notches respectively aligning with said first notches and through which said the other end of the tool extends.

2. The tool holder according to claim 1, wherein each said resilient member is arcuate and includes a depression defined in a mediate section thereof.

3. The tool holder according to claim 1, wherein each said first notch is oblong and extends in a direction at an acute angle with a lengthwise direction of the end wall.

4. The tool holder according to claim 1, wherein each said second notch is oblong and extends in a direction at an acute angle with a lengthwise direction of the restraining member.

5. The tool holder according to claim 1, wherein the restraining member includes at least one snapping fastener with a snapping head, and the bottom wall of the main body includes at least one hole defined therein through which the snapping head is passable.

* * * * *